US005903242A

United States Patent [19]

Tsuru et al.

[11] Patent Number: 5,903,242

[45] Date of Patent: May 11, 1999

[54] HELICAL ANTENNA AND METHOD OF MAKING SAME

[75] Inventors: Teruhisa Tsuru, Kameoka; Harufumi Mandai, Takatsuki; Seiji Kanba, Otsu; Koji Shiroki; Kenji Asakura, both of Shiga-ken, all of Japan

[73] Assignee: Murata Manufacturing Co., Ltd., Japan

[21] Appl. No.: 08/718,967

[22] Filed: Sep. 26, 1996

[30] Foreign Application Priority Data

Oct. 24, 1995 [JP] Japan ..... 7-275704

[51] Int. Cl.[6] ..... H01Q 1/36; H01Q 1/40

[52] U.S. Cl. ..... 343/873; 343/788; 343/895

[58] Field of Search ..... 343/873, 895, 343/872, 749, 788, 702; H01Q 1/36, 1/40

[56] References Cited

U.S. PATENT DOCUMENTS

| | | | |
|---|---|---|---|
| 3,638,226 | 1/1972 | Brooks et al. | 343/873 |
| 3,823,403 | 7/1974 | Walter et al. | 343/787 |
| 4,772,895 | 9/1988 | Garay et al. | 343/895 |
| 5,146,235 | 9/1992 | Frese | 343/895 |

FOREIGN PATENT DOCUMENTS

| | | |
|---|---|---|
| 393762 | 5/1991 | Austria . |
| 143506 | 6/1985 | European Pat. Off. . |

OTHER PUBLICATIONS

The ARRL Antenna Book, Published by The ARRL, Newington, CT., pp. 6–6 to 6–8, 15th ed., 1988.

*Primary Examiner*—Michael C. Wimer
*Attorney, Agent, or Firm*—Ostrolenk, Faber, Gerb & Soffen, LLP

[57] ABSTRACT

A helical antenna is provided in which a predetermined resonance frequency can be determined at the design stage. The helical antenna includes a conductor which is formed from copper or a copper alloy inside a base in the shape of a rectangular parallelopiped formed from a dielectric material having barium oxide, aluminum oxide and silica as main constituents and which is wound in a helical shape along the length of the base. In such a case, the resonance frequency f0 of the helical antenna and the inductance components L of the conductor satisfy the relationship: ln (L)=A0+A1×ln (f0), where ln is a natural logarithm, and A0 and A1 are constants. One end of the conductor is extended onto the surface of the base and forms a power feeding terminal connected to a power feeding terminal formed on the surface of the base for applying a voltage to the conductor, and the other end thereof forms a free end inside the base.

20 Claims, 5 Drawing Sheets

HELICAL ANTENNA AND METHOD OF MAKING SAME

BACKGROUND OF THE INVENTION

1. Field of the Invention

The present invention relates to a helical antenna for use in mobile communications and local area networks (LAN).

2. Description of the Related Art

It is important for an antenna for use in mobile communications and local area networks to be small. As one type of antenna which satisfies such a demand, there is a normal-mode helical antenna. FIG. 6 shows the construction of the normal-mode helical antenna.

A normal-mode helical antenna 1 shown in FIG. 6 is formed in such a way that a linear conductor is wound so that a winding cross section 3 intersecting at right angles to a winding axis C is formed substantially in the shape of a circle, with a power feeding section 4 being provided on one end of the normal-mode helical antenna 1 and the other end being formed into a free end 5.

However, in the above-described conventional normal-mode helical antenna, since the relationship between the resonance frequency and the inductance components of a conductor has not been clarified, it is difficult to determine with ease the structural parameters of the conductor for obtaining a desired resonance frequency, for example, the winding cross section of the conductor, the number of windings of the conductor, or the coil length of the conductor, at the design stage.

SUMMARY OF THE INVENTION

The present invention has been achieved to solve such problems. It is an object of the present invention to provide a helical antenna in which a desired resonance frequency is capable of being determined at the design stage.

To achieve the above and other objects, according to one aspect of the present invention, there is provided a helical antenna wherein a resonance frequency f0 and inductance components L of a conductor which is wound in a helical shape satisfy the following relation: $\ln(L)=A0+A1\times\ln(f0)$, where ln is a natural logarithm, and A0 and A1 are constants According to another aspect of the present invention, there is provided a helical antenna wherein the relative bandwidth (bandwidth W/resonance frequency f0) of the helical antenna and the relative coil length (coil length "a"/wavelength λ) of the conductor satisfy the following relation: $W/f0=B0+B1\times(a/\lambda)$, where B0 and B1 are constants According to a further aspect of the present invention, there is provided a helical antenna wherein the conductor is provided at least either on the surface of or in the inside of a base formed from at least one of a dielectric material or a magnetic material, and at least one power feeding terminal for applying a voltage to the conductor is provided on the surface of the base.

Because of this construction, it is possible to easily determine the inductance components of the conductor required for a desired resonance frequency on the basis of $\ln(L)=A0+A1\times\ln(f0)$.

Further, it is possible to easily determine the coil length of the conductor required for a relative bandwidth on the basis of $W/f0=B0+B1\times(a/\lambda)$.

Also, the combination of the conductor with a base formed from at least either one of a dielectric material or a magnetic material causes the propagation velocity to become slow and wavelength shortening to occur. Therefore, when the relative dielectric constant of the dielectric material and the magnetic material is denoted as $\epsilon$, the effective line length of the conductor becomes $\epsilon^{1/2}$ times as great The above and further objects, aspects and novel features of the invention will become more apparent from the following detailed description when read in connection with the accompanying drawings Other features and advantages of the present invention will become apparent from the following description of the invention which refers to the accompanying drawings

DETAILED DESCRIPTION OF EMBODIMENTS OF THE INVENTION

Figure 1:
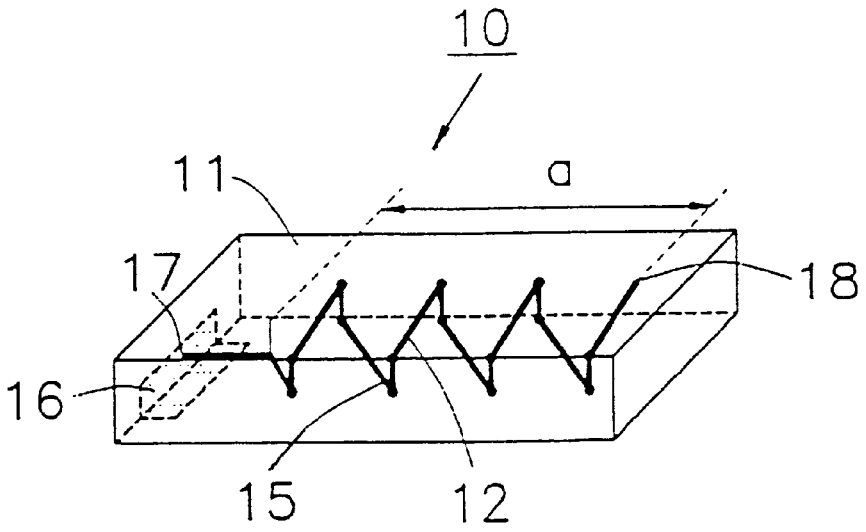
FIG. 1 is a perspective view of an embodiment of a helical antenna according to the present invention.
Figure 2:
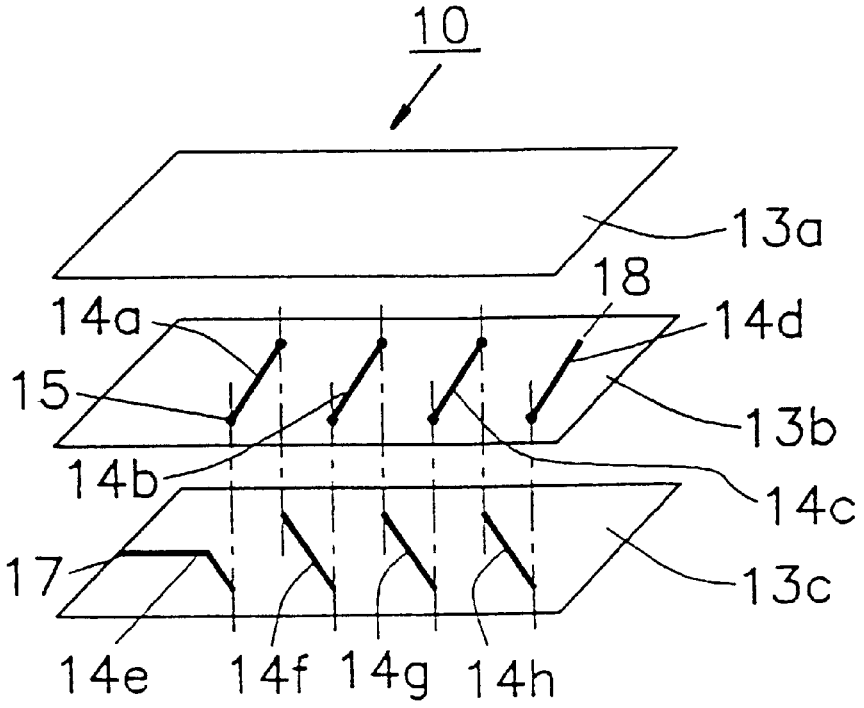
FIG. 2 is an exploded, perspective view of the helical antenna of FIG. 1.

FIG. 1 shows a perspective view of an embodiment of a helical antenna according to the present invention. FIG. 2 is an exploded perspective view thereof.

A helical antenna 10 comprises a conductor 12 which is wound in a helical shape along the length of a base 11 inside the base 11 in the shape of a rectangular parallelopiped. The base 11 comprises a lamination of sheet layers 13*a* to 13*c* in the shape of a rectangle formed from a dielectric material having barium oxide, aluminum oxide and silica as main constituents. Formed on the surfaces of the sheet layers 13*b* and 13*c* from among the sheet layers are conductive patterns 14*a* to 14*h* which are made of, e.g., copper or a copper alloy and which are formed in a straight line by printing, vapor deposition, pasting or plating, and viaholes 15 are provided in the sheet layers 13*b* and 13*c* along the thickness thereof. Then, the sheet layers 13*a* to 13*c* are laminated, and the conductive patterns 14*a* to 14*h* are connected to each other through the viaholes 15. Thus, a conductor 12 whose winding cross section is formed in the shape of a rectangle and which is wound in a helical shape is formed.

Further, one end (one end of a conductive pattern 14*e*) of the conductor 12 is extended onto the surface of base 11 and forms a power feeding section 17 connected to a power feeding terminal 16 formed on the surface of the base 11 in order to apply a voltage to the conductor 12. The other end (one end of the conductive pattern 14*d*) of the conductor 12 forms a free end 18 inside the base 11. As indicated by "a" in FIG. 1, the length of a portion of the conductor 12 of a helical shape which forms the coil is the coil length.

Figure 3:
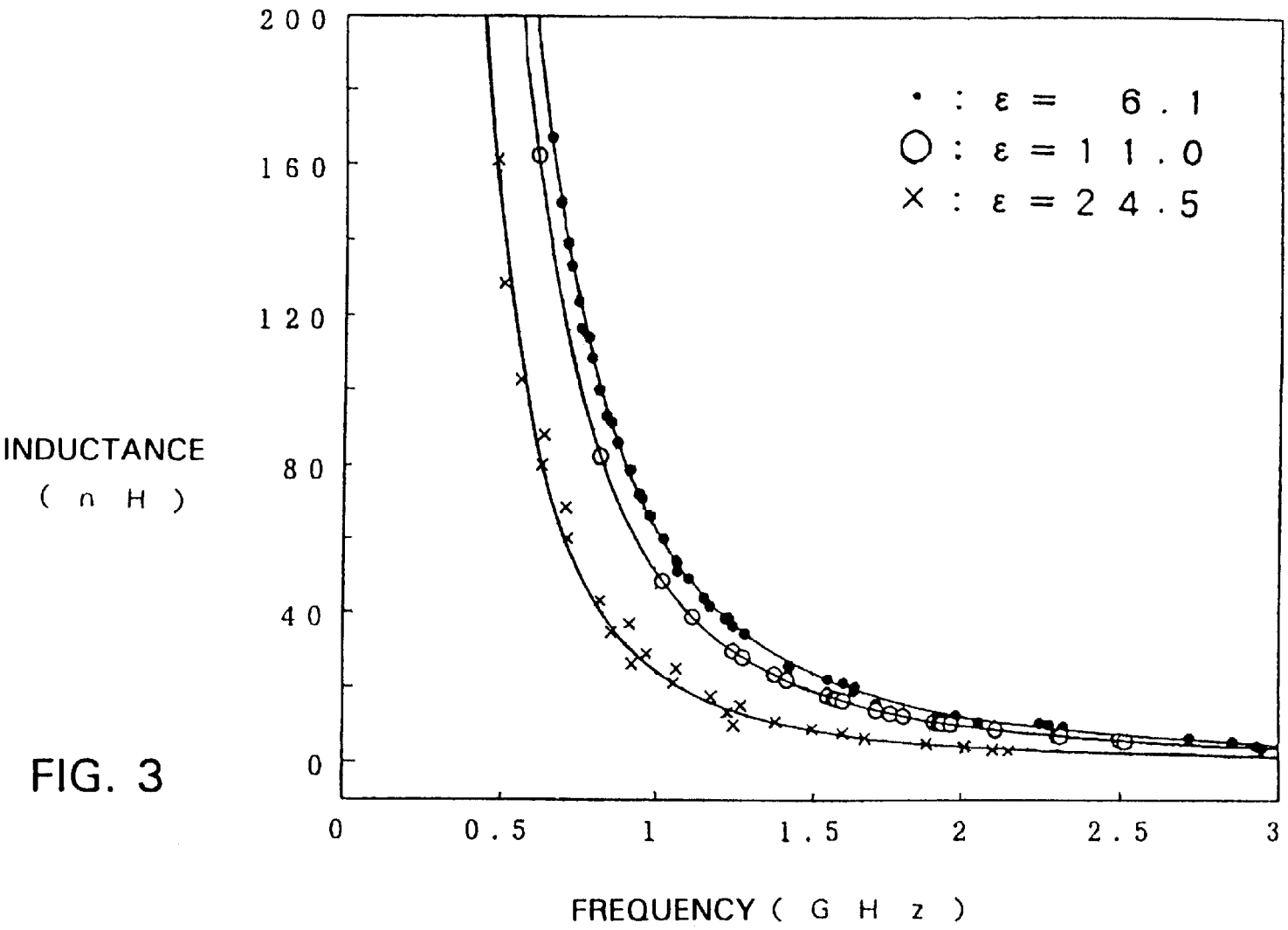
FIG. 3 shows the relationship between the resonance frequency of the helical antenna and the inductance components in which the relative dielectric constants of the base are 61, 10.0 and 24.5.

FIG. 3 shows the relationship between the resonance frequency of the helical antenna 10 and the inductance components of the conductor 12 in a case in which a dielectric material ($\epsilon$=6.1) having barium oxide, aluminum oxide and silica as main constituents, a dielectric material ($\epsilon$=10.0) having magnesium oxide and silica as main constituents, and a dielectric material ($\epsilon$=24.5) having calcium oxide, magnesium oxide, aluminum oxide and silica as main constituents are used for the base 11.

It is shown from FIG. 3 that the relationship between the resonance frequency of the helical antenna 10 and the inductance components of the conductor 12 conforms to the same recurrent formula described below even if the value of $\epsilon$ is changed:

$$ln(L)=A0+A1\times ln(f0) \quad (1)$$

where A0 and A1 are constants, f0 is the resonance frequency of the helical antenna, and L is the inductance components of the conductor 12. The constants A0 and A1 in each dielectric material are shown in Table 1 below.

TABLE 1

| | $\epsilon$ = 6.1 | $\epsilon$ = 10.0 | $\epsilon$ = 24.5 |
|---|---|---|---|
| A0 | 4.136 | 3.929 | 3.929 |
| A1 | −2.395 | −2.437 | −2.437 |

The relationship between the inductance components of the conductor 12 and the structural parameters of the conductor 12, namely, the winding cross section of the conductor 12, the number of windings of the conductor 12 and the coil length of the conductor 12, is:

$$L=K\times\mu\times S\times(n^2/a) \quad (2)$$

where K is the Nagaoka coefficient, $\mu$ is the magnetic permeability of the base 11, S is the winding cross section of the conductor 12, n is the number of windings of the conductor 12, and "a" is the coil length of the conductor 12. The Nagaoka coefficient is defined as: $K=1/(1+0.9\ r/a-0.02\ (r/a)^2)$ where r is the radius of the winding and a is the length of the winding A method of determining the structural parameters of the conductor 12 from the desired resonance frequency f0 will now be described Initially, when L in equations (1) and (2) are equated, the following can be obtained:

$$n=\{(e^{A0}\times f0^{A1})/(\mu\times S)\}^{1/2}\times(a/K)^{1/2} \quad (3)$$

Figure 4:
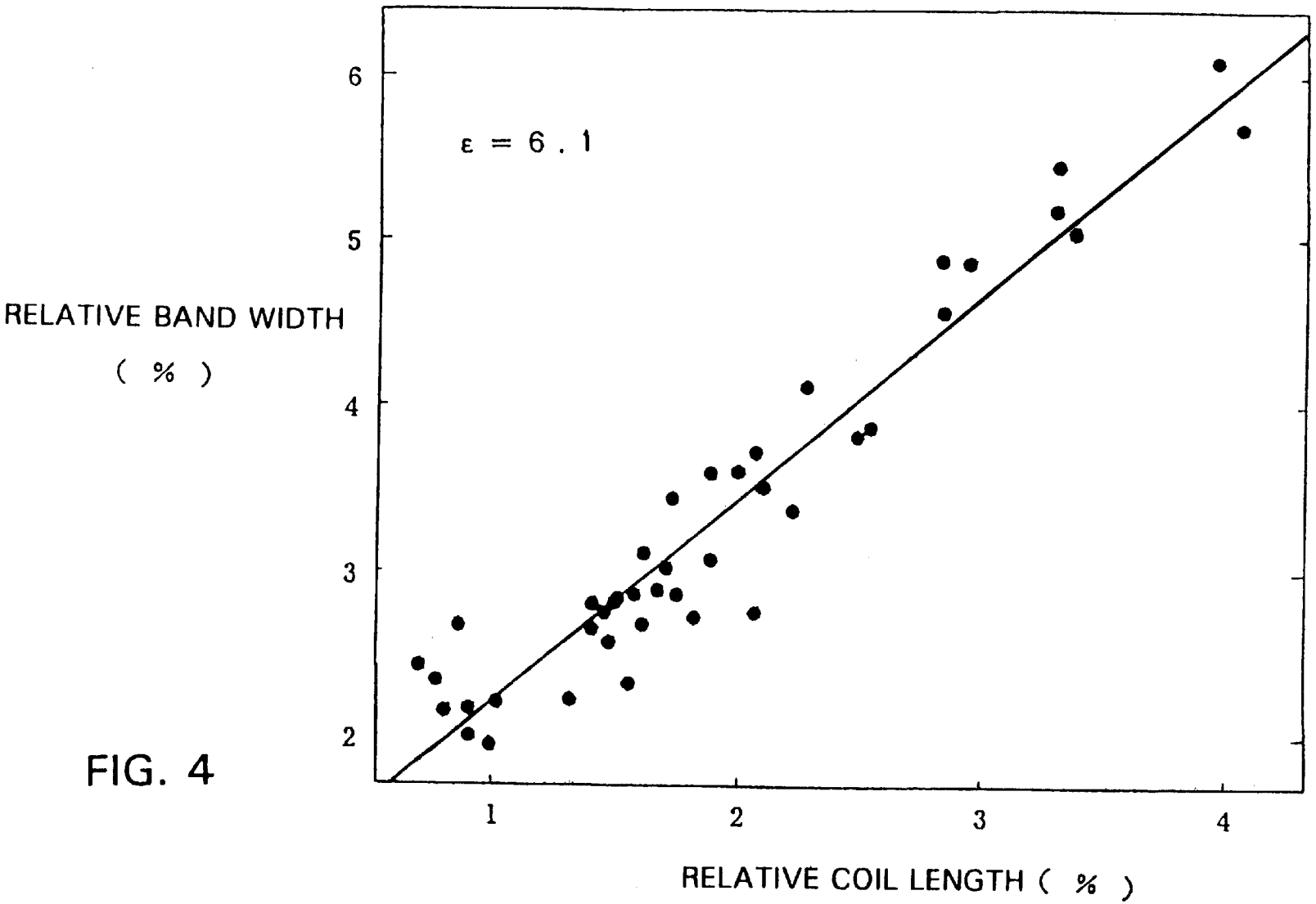
FIG. 4 shows the relationship between the relative bandwidth of the helical antenna and the relative coil length in which the relative dielectric constant of the base is 6.1.
Figure 5:
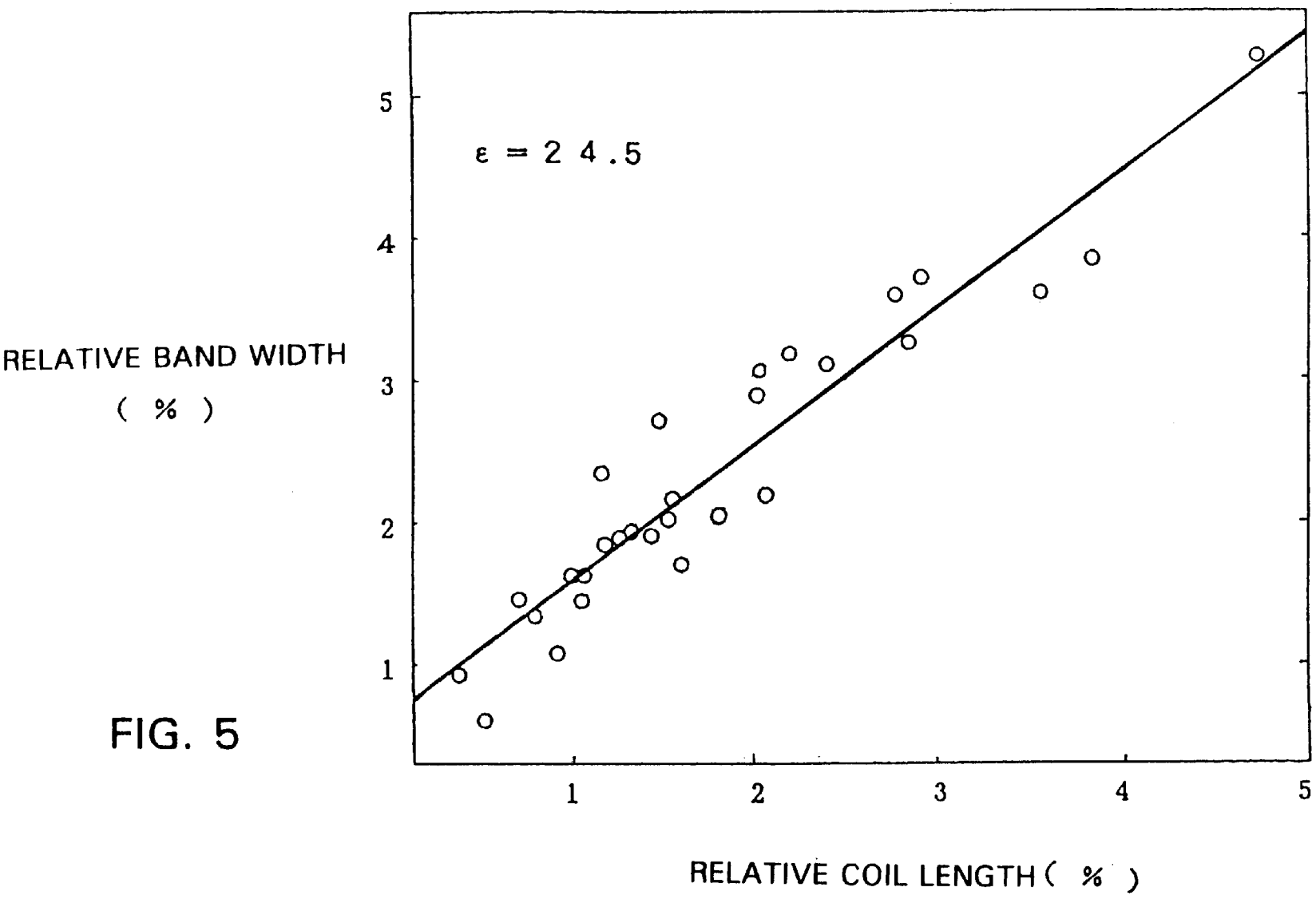
FIG. 5 shows the relationship between the relative bandwidth of the helical antenna and the relative coil length in which the relative dielectric constant of the base is 24.5.
Figure 6:
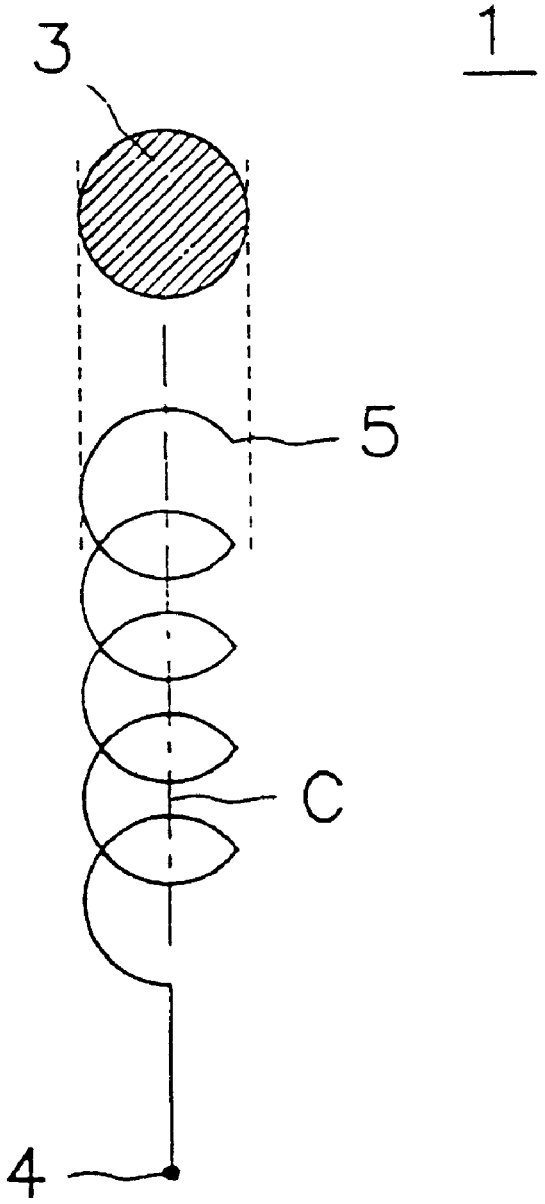
FIG. 6 PRIOR ART
FIG. 6 shows the construction of a conventional helical antenna.

Next, FIG. 4 shows the relationship between the relative bandwidth (bandwidth W/resonance frequency f0) of the helical antenna 10 and the relative coil length (coil length "a"/wavelength $\lambda$) of the conductor 12 in a case in which a dielectric material ($\epsilon$=6.1) having barium oxide, aluminum oxide and silica as main constituents is used for the base 11. FIG. 5 shows the relationship between the relative band width (band width W/resonance frequency f0) of the helical antenna 10 and the relative coil length (coil length "a"/wavelength $\lambda$) of the conductor 12 in a case in which a dielectric material ($\epsilon$=24.5) having calcium oxide, magnesium oxide, aluminum oxide and silica as main constituents is used for the base 11.

It is shown from FIGS. 4 and 5 that the relationship between the resonance frequency of the helical antenna 10 and the inductance components of the conductor 12 conforms to the same recurrent formula even if the value of $\epsilon$ is changed:

$$W/f0=B0+B1\times(a/\lambda) \quad (4)$$

where B0 and B1 are constants, W is the bandwidth of the helical antenna 10, "a" is the coil length of the conductor 12, and $\lambda$ is the wavelength determined from the actually measured resonance frequency. Table 2 shows the values of constants B0 and B1 in each dielectric material.

TABLE 2

| | $\epsilon$ = 6.1 | $\epsilon$ = 24.5 |
|---|---|---|
| B0 | 1.020 | 1.222 |
| B1 | 0.6624 | 0.9572 |

Therefore, according to the above-described embodiment, the winding cross section S of the conductor and the coil length "a" of the conductor are inevitably determined on the basis of the size of the helical antenna. Therefore, when the desired resonance frequency is substituted for f0 in equation (3), the number n of windings of the conductor is determined, and the structural parameters of the conductor are determined As a result, it becomes possible to determine the structural parameters of the conductor for obtaining the desired resonance frequency f0, namely, the winding cross section of the conductor and the coil length of the conductor, at the design stage.

Also, based on equation (4), when the resonance frequency f0 is the same, the bandwidth W depends upon the coil length "a". Therefore, it becomes possible to determine the coil length "a" of the conductor for obtaining the desired bandwidth W.

Further, since a base formed from a dielectric material is used, the propagation velocity becomes slow, and wavelength shortening occurs. As a result, when the relative dielectric constant of the dielectric material is denoted as $\epsilon$, the effective line length of the conductor becomes $\epsilon^{1/2}$ times as great and thus becomes longer than the effective line length of the conventional helical antenna. Therefore, since the region of the current distribution is increased, the amount of electromagnetic waves to be radiated is increased, making it possible to increase the gain of the antenna.

Conversely, when the helical antenna is made to have the same characteristics as those of a conventional helical antenna, the line length becomes one $\epsilon^{1/2}$-th, and therefore, it becomes possible to form the helical antenna in a small size.

Although the above-described embodiment describes a helical antenna having a base formed from a dielectric material, the helical antenna may be formed from only a conductor as in the prior art.

Although the above-described embodiment describes a case in which the base is formed from a dielectric material, the material of the base is not limited to a dielectric material, but may be formed from a magnetic material or a combination of a dielectric material and a magnetic material.

In addition, although the above-described embodiment describes a case in which one conductor is used, two or more conductors may be used.

Although the above-described embodiment describes a case in which a conductor is formed inside a base, a conductive pattern may be wound at least either on the surface of or in the inside of the base in order to form a conductor. Further, a helical groove may be provided on the surface of a base, to wind a wire material, such as a plated wire or an enameled wire, along the groove in order to form a conductor. Furthermore, the conductor ,may be formed in a meander shape at least either on the surface or in the inside of the base.

In addition, the position of the power feeding terminal shown is not an indispensable condition for carrying out the present invention. The feeding terminal can be disposed in other positions.

According to the helical antenna described, the inductance components of the conductor required for the desired resonance frequency can be easily determined from ln (L)=A0+A1×ln (f0). Therefore, by combining the above ln (L)=A0+A1×ln (f0) and $L=K\times\mu\times S\times(n^2/a)$ indicating the relationship of inductance components of the conductor and the structural parameters of the conductor, the structural parameters of the conductor for obtaining the desired resonance frequency f0, namely, the winding cross section S of the conductor, the number n of windings of the conductor and the coil length "a" of the conductor may be determined at the design stage.

According to the helical antenna described above, the coil length "a" of the conductor required for obtaining the desired bandwidth W can be easily determined at the design stage.

According to one embodiment of the helical antenna described above, since a base formed from at least one of a dielectric material or a magnetic material is used, the propagation velocity becomes slow, and wavelength shortening occurs. As a result, when the relative dielectric constant of the dielectric material and the magnetic material is denoted as $\epsilon$, the effective line length of the conductor becomes $\epsilon^{1/2}$ times as great and becomes longer than the effective line length of the conventional helical antenna. Therefore, since the region of the current distribution increases, the amount of electromagnetic waves to be radiated increases. Thus, it becomes possible to increase the gain of the antenna.

When, conversely, the helical antenna is made to have the same characteristics as those of the conventional helical antenna, the line length becomes one $\epsilon^{1/2}$-th. Thus, it becomes possible to form the helical antenna in a small size.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A helical antenna comprising a conductor having a helical shape, the conductor having a resonance frequency f0 and an inductance L, the inductance L and resonance frequency f0 satisfying the following relation: ln (L)=A0+A1× ln (f0), where ln is a natural logarithm, and A0 and A1 are constants and further wherein the helical antenna comprises a substrate having a surface, the conductor being disposed spirally on the surface of the dielectric substrate or in the substrate; a power supply terminal provided on a portion of the surface of the substrate for applying voltage to the conductors the conductor having one end coupled to the power supply terminal and a second end left unconnected, the substrate comprising a base comprising a plurality of layers stacked on top of each others the stacked layers establishing a direction normal to the stacked layers, the conductor disposed spirally such that the conductor has a spiral axis extending perpendicular to the direction normal to the stacked layers.

2. The helical antenna according to claim 1, wherein the antenna has a relative bandwidth defined as bandwidth W/resonance frequency f0 and a relative coil length defined as coil length a/wavelength $\lambda$, the relative bandwidth and relative coil length of said conductor satisfying the following relation: W/f0=B0+B1×(a/$\lambda$), where B0 and B1 are constants.

3. The helical antenna according to claim 1, wherein respective ones of said layers have a portion of the conductor disposed thereon, at least one of said layers having at least one conductive through hole therein, the conductive through hole adapted to electrically couple portions of said conductor disposed on respective ones of said layers when said layers are laminated together, thereby forming said helical conductor.

4. The helical antenna according to claim 1, wherein the conductor has a rectangular shape in cross section.

5. The helical antenna according to claim 1, wherein a relationship between the inductance L of the conductor and structural parameters of the conductor comprising a winding cross section S of the conductor, a number n of windings of the conductor and a coil length a of the conductor is $L=K\times u\times S\times(n^2/a)$ where K is the Nagaoka coefficient and u is the magnetic permeability of the base, the Nagaoka coefficient being defined as $K=1/(1+0.9\ r/a-0.02\ (r/a)^2)$ where r is the radius of the coil and a is the coil length.

6. A helical antenna according to claim 1, wherein the base comprises one of a dielectric material, a magnetic material and a combination of a dielectric material and a magnetic material.

7. A helical antenna according to claim 1 wherein the conductor comprises a conductor disposed in a helical groove on the surface of the base.

8. A helical antenna according to claim 1, wherein the conductor has a meander shape and said conductor is disposed on one of a surface of the base and inside the base.

9. A helical antenna according to claim 1 wherein the base comprises a dielectric material having barium oxide, aluminum oxide and silica as constituents.

10. A helical antenna according to claim 1, wherein the base comprises a dielectric material having calcium oxide, magnesium oxide, aluminum oxide and silica as constituents.

11. A helical antenna according to claim 1, wherein the base comprises a dielectric material having magnesium oxide and silica as constituents.

12. The helical antenna according to claim 1, wherein the conductor comprises a copper or copper alloy.

13. A helical antenna according to claim 1, wherein the base comprises a rectangular parallelopiped.

14. A method for making a helical antenna having a desired resonance frequency f0, the method comprising the steps of:

forming a conductor on or in a base in a helical shape and determining structural parameters of the conductor to obtain the desired resonance frequency f0, the structural parameters comprising a winding cross-section S of the conductor, a number n of windings of the conductor and a coil length a of the conductor based upon the following relationships:

$L=K\times\mu\times S\times(n^2/a)$, where K is the Nagaoka coefficient, $\mu$ is the magnetic permeability of the base and L is the inductance of the conductor, the Nagaoka coefficient being defined as $K=1/(1+0.9\ r/a-0.02\ (r/a)^2)$ where r is the radius of the coil and a is the coil length; and ln (L)=A0+A1×ln (f0), where A0 and A1 are coefficients determined by the dielectric material of the base, and further wherein the base of the helical antenna comprises a substrate having a surface, the conductor being disposed spirally on the surface of the substrate or in the substrate; a power supply terminal provided on a portion of the surface of the substrate for applying voltage to the conductor, the conductor having one end coupled to the power supply terminal and a second end left unconnected, the substrate comprising a plurality of layers stacked on top of each other, the stacked layers establishing a direction normal to the stacked layers, the conductor disposed spirally such that it has a spiral axis extending perpendicular to the direction normal to the stacked layers.

15. The method for making a helical antenna according to claim 14, further comprising determining the coil length a of the conductor for obtaining a desired bandwidth W from the equation: $W/f0=B0+B1\times(a/\lambda)$ where $\lambda$ is the wavelength and B0 and B1 are constants determined by the dielectric material of the base.

16. A method for forming a helical antenna having a desired resonance frequency f0 comprising forming a conductor into a helical shape on a base of dielectric material, the conductor having an inductance L wherein the inductance L satisfies a relationship $\ln(L)=A0+A1\times\ln(f0)$ where A0 and A1 are constants determined by the dielectric material, and further wherein the base of dielectric material has a surface, the conductor being disposed spirally on the surface of the base or in the base; a power supply terminal provided on a portion of the surface of the base for applying voltage to the conductor, the conductor having one end coupled to the power supply terminal and a second end left unconnected, the base comprising a plurality of layers stacked on top of each other, the stacked layers establishing a direction normal to the stacked layers, the conductor disposed spirally such that it has a spiral axis extending perpendicular to the direction normal to the stacked layers.

17. The method according to claim 16, further comprising determining a bandwidth W of the helical antenna based on the following equation: $W/f0=B0+B1\times(a/\lambda)$ where a is the coil length of the conductor, B0 and B1 are constants determined by the dielectric material of the base and $\lambda$ is the wavelength.

18. The method according to claim 16, further comprising determining the inductance L of the conductor according to the following equation: $L=K\times\mu\times S\times(n^2/a)$ where K is the Nagaoka coefficient, $\mu$ is the magnetic permeability of the base, S is the winding cross-section of the conductor, n is the number of windings of the conductor and a is the coil length of the conductor, the Nagaoka coefficient being defined as $K=1/(1+0.9\ r/a-0.02\ (r/a)^2)$ where r is the radius of the coil and a is the coil length.

19. A method for determining structural parameters of a helical antenna given a desired resonance frequency f0, the method comprising:

determining a winding cross-section S, coil length a and number of winding turns n of a conductor of the helical antenna based on the formula:

$$n=\{(e^{A0}\times f0^{A1})/(\mu\times S)\}^{1/2}\times(a/K)^{1/2}\ where$$

A0 and A1 are constants determined by a dielectric material through which the conductor traverses, e is the dielectric constant of the dielectric material, $\mu$ is the magnetic permeability of the dielectric material and K is the Nagaoka coefficient, the Nagaoka coefficient being defined as $K=1/(1+0.9\ r/a-0.02\ (r/a)^2)$ where r is the radius of the coil and a is the coil length; and further wherein the helical antenna comprises a dielectric substrate having a surface, the conductor being disposed spirally on the surface of the dielectric substrate or in the substrate; a power supply terminal provided on a portion of the surface of the dielectric substrate for applying voltage to the conductor, the conductor having one end coupled to the power supply terminal and a second end left unconnected, the dielectric substrate comprising a plurality of layers stacked on top of each others the stacked layers establishing a direction normal to the stacked layers, the conductor disposed spirally such that it has a spiral axis extending perpendicular to the direction normal to the stacked layers.

20. A method for making a helical antenna having a defined resonance frequency f0 and bandwidth W, the method comprising the steps of:

choosing a winding cross section S of the helical antenna, a number n of turns of the winding of the antenna and a coil length a of the helical antenna according to the equations:

$L=K\times\mu\times S\times(n^2/a)$ where K is the Nagaoka coefficient, n is the magnetic permeability of the material through what the winding traverses; and L is the inductance the Nagaoka coefficient being defined as $K=1/(1+0.9\ r/a-0.02\ (r/a)^2)$ where r is the radius of the coil and a is the coil length;

$\ln(L)=A0+A1\times\ln(f0)$ where A0 and A1 are constants determined by the material through which the winding traverses; and $W/f0=B0+B1\times(A/\lambda)$ where B0 and B1 are constants determined by the material through which the winding traverses and $\lambda$ is the wavelength; and further wherein the helical antenna comprises a substrate having a surface, the winding comprising a conductor disposed spirally on the surface of the substrate or in the substrate; a power supply terminal provided on a portion of the surface of the substrate for applying voltage to the conductor, the conductor having one end coupled to the power supply terminal and a second end left unconnected, the substrate comprising a plurality of layers stacked on top of each other, the stacked layers establishing a direction normal to the stacked layers, the conductor disposed spirally such that it has a spiral axis extending perpendicular to the direction normal to the stacked layers.

* * * * *